United States Patent [19]

Mergell

[11] 4,184,648

[45] Jan. 22, 1980

[54] METHOD AND DEVICE FOR CONTINUOUSLY PRODUCING ROLLS OF WEB MATERIAL

[75] Inventor: Wolfgang Mergell, Niederbröl, Fed. Rep. of Germany

[73] Assignee: Mergell Kommanditgesellschaft, Niederbröl, Fed. Rep. of Germany

[21] Appl. No.: 808,652

[22] Filed: Jun. 21, 1977

[51] Int. Cl.[2] ..... B65H 19/26; B65H 17/14

[52] U.S. Cl. ..... 242/56 R; 242/75.1

[58] Field of Search ..... 242/56 R, 66, 74, 76, 242/75.1, 79, DIG. 3, 56.2, 65

[56] References Cited

U.S. PATENT DOCUMENTS

| | | | |
|---|---|---|---|
| 2,830,775 | 4/1958 | Kiesel | 242/56 R |
| 2,939,645 | 6/1960 | Rowlands et al. | 242/66 X |
| 3,049,314 | 8/1962 | Criger | 242/79 |
| 3,585,779 | 6/1971 | Thayer | 242/56 R |
| 3,702,381 | 3/1973 | Rehme et al. | 242/56 R |

*Primary Examiner*—Harvey C. Hornsby
*Assistant Examiner*—John M. Jillions
*Attorney, Agent, or Firm*—Becker & Becker, Inc.

[57] ABSTRACT

A method of and device for producing rolls of web material, especially self-supporting material such as sheet metal, in a continuous process which is divided into timewise and locally separated on-winding and winding-up phases. The on-winding is effected automatically in a space or chamber corresponding in shape to the shape of the desired initial roll to be produced. This on-winding is carried out on mandrels extending from opposite sides into the above mentioned space or chamber. When the initial roll of web material has been prepared, the latter is conveyed by the mandrels to a winding-up station. Here, the mandrels are withdrawn from the roll prepared so far and returned to the on-winding station for producing another initial roll, and further layers of web material at the winding-up station are wound up and around the initial roll of web material by feeding web material to the winding-up station, until the roll has reached its desired diameter. When the roll has reached its desired shape, its last coil is cut-off from further supply, and the finished roll is discharged, and the cycle is repeated.

3 Claims, 2 Drawing Figures

METHOD AND DEVICE FOR CONTINUOUSLY PRODUCING ROLLS OF WEB MATERIAL

The present invention relates to a method and a device for continuously preparing webs of material of different length and width with or without sleeves, according to which the material is wound into rolls. Webs of material of different length and different width are as a rule wound off a parent roll and wound into rolls. The preparation of a so-called onwinding body onto which the material is to be wound has heretofore been effected by means of a sleeve or a parent mandrel.

Two methods are known for applying one band end onto the sleeve. According to one method, the band end is manually glued onto the sleeve body or applied thereto. According to the other method, the gluing on or application of one band end without a sleeve is effected mechanically.

It has furthermore been suggested to effect the application of one band end without a sleeve, in which instance instead of a sleeve a so-called parent mandrel is employed.

It is desirable to effect the application of one band end to the winding-on body without the above mentioned auxiliary elements in the form of sleeves or mandrels, and to combine the web material to be wound up with the winding-on body or to make the winding-on body out of the web material itself. This endeavor is of particular importance inasmuch as by finding a suitable solution, the winding off of the web material from a parent roll onto a plurality of individual rolls can be effected fully automatically.

It is, therefore, an object of the present invention to provide a method and device by means of which web material of different length and different width can in a continuous operation be wound into rolls while the web material itself will be used for forming a winding-on body.

These and other objects and advantages of the invention will appear more clearly from the following specification in connection with the accompanying drawings, in which.

Figure 1:
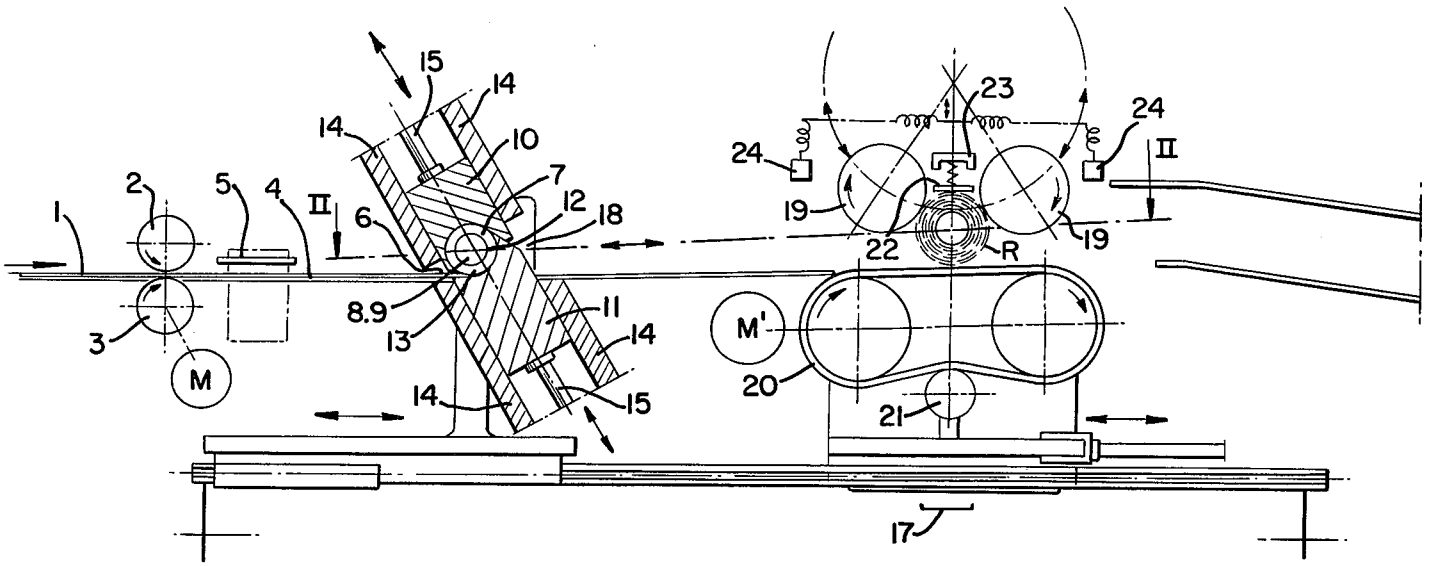
FIG. 1 is a vertical section through portions of a device according to the present invention.
Figure 2:
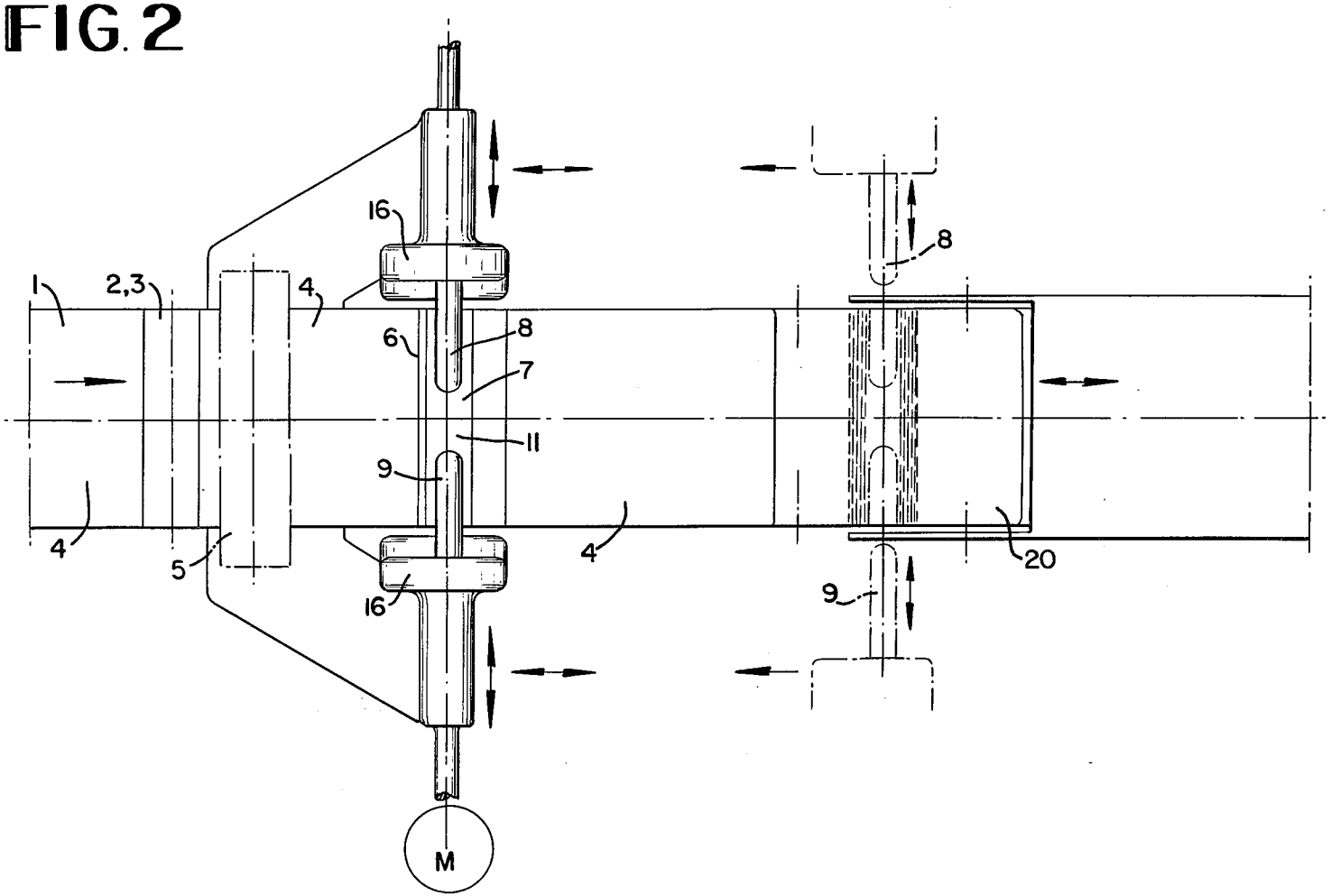
FIG. 2 represents a horizontal section taken along the line II—II of FIG. 1.

The method according to the present invention is characterized primarily by timewise and locally separated winding-on and winding-up phases, while the winding-on is effected automatically in a free space corresponding to the roller form, onto mandrels laterally engaging said free space. When a certain number of layers have been obtained, the mandrel with the web material thereon is conveyed to a winding-up station in which after removal of the mandrel, the further winding-up of the web material is effected in a system of guiding rollers and a circulating endless guiding belt. When the intended web length has been obtained, the web material is cut and the roller with the web material is ejected. The advantage obtained by the present invention consists in the timewise and local separation of the winding-on and winding-up operation. In this way, it will be realized that the web material to be wound up can be used as a winding-up body. This in turn brings about the advantage that the heretofore employed sleeves or parent mandrels need no longer be used whereby previously the course of the process was automatically interfered with when the predetermined web lengths were obtained.

A device for carrying out the method according to the present invention is characterized primarily in that in the conveying direction behind the material cutting station in an inclined guiding direction opposite to the web conveying direction with a material inlet and a mandrel outlet, bowl-shaped bodies with semi-cylindrical recesses are provided. When the device is in its closing position, rotating onwinding mandrels with a free-wheel drive, counter to the web conveying direction, engage from both sides at a speed of the webs that free space which is formed by the semi-cylindrical recesses. Onwinding mandrels with the wound-on layers of material are after opening said bowl-shaped bodies displaceable at a speed not exceeding the web speed to the winding-up station proper through the mandrel discharge. The wound-up roll of material is here grasped by guiding rollers, and the winding-up of the web of material is continued by said guiding rollers and an endless belt. The mandrels are laterally moved outwardly and return to the onwinding station to their starting position. The bowl-shaped bodies of the onwinding station are, however, moved together again only when at the cutting station the cutting of the material is effected, the winding-up station has advanced in web-conveying direction, and the web end has left the mandrel discharge, and when after the material band end has reached the winding-up station, the guiding rollers are pivoted upwardly, and the finished roller is ejected by the belt 20, and the winding-up station returns to its starting position.

The advantages realized by the present invention consist in that due to the strict division of the entire winding-up operation into an onwinding phase and a winding-up phase following said onwinding phase, there is obtained the possibility of automating the entire working process. In this connection, it is important that the onwinding phase carried out with or without sleeve and without parent mandrel, while the structural elements referred to above, which are simple in design and low in cost, permit the realization of the object underlying the present invention.

The method according to the present invention may be summarized as follows: the web material coming from the parent roller is first by means of auxiliary devices known per se introduced into a free cylinder chamber into which mandrels extend. In this free cylinder chamber, by means of the there introduced mandrels, a winding-up base body is produced from the web material itself. This phase is in the present case termed "onwinding phase" while the thus created onwinding body is composed of a plurality of web layers of the material to be wound up. When a certain predetermined number of layers has been obtained, the thus created base body is transferred to the winding-up station proper. By the employment of likewise known auxiliary devices such as guiding rollers and at least one endless circulating belt, the rollers are produced with a certain web length. The above mentioned auxiliary devices for producing a winding-up base body and for winding up the web material are as to their function adapted to each other in such a way that when the winding-up phase is completed, immediately a new onwinding phase starts which, however, automatically at another station transforms into a winding-up phase. This cycle can be maintained until the parent roller has been completely unwound so that the entire rewinding process can take place fully automatically.

Referring now to the drawings in detail, the web material 1 withdrawn from a non-illustrated parent roller or from a non-illustrated roller cutting machine first passes through the intervention of transporting rollers 2 and 3 driven by motor means M and a guiding station following said transporting rollers and provided with a cutting station 5, into the material inlet 6 and from there into a free space or chamber 7 into which onwinding mandrels 8,9 extend from both sides. The free chamber 7 is formed by bowl-shaped bodies 10,11 which are provided with semi-cylindrical recesses 12, 13. The bowl-shaped bodies 10,11 are in a positive guiding system 14 movable first to obtain the opening and closing positions respectively. As auxiliary elements for the bowl-shaped bodies 10, 11, auxiliary elements 15 are employed which may be actuated hydraulically, pneumatically, or mechanically.

The mandrels 8, 9 which extend into the free chamber 7 are provided with a means for conveying thereof including free wheel system or device 16 in order to assure that when the mandrels are displaced from the onwinding station to the winding-up station 17 proper, the web of material will not tear off if the speed of the web should be exceeded. In this connection, it is desirable that the movement of the mandrels 8,9 from the onwinding station to the winding-up station 17 is effected at a speed which does not exceed the speed of the web through the mandrel outlet 18. The speed of movement of the mandrels 8,9 from the onwinding station to the winding-up station 17 may, however, also be less than the speed of the web through the mandrel outlet 18. Whereas in the first instance the rotation of the mandrels is interrupted, in the second instance a further onwinding is possible at a lower circumferential speed. When a certain web length has been onwound, the bowl-shaped bodies 10, 11 are moved away from each other by means of the auxiliary elements 15 and the mandrels 8,9 are through the mandrel outlet 18 advanced to the winding-up station 17 proper. As will be seen in FIG. 1, the guiding rollers 19 are arranged so as to be pivotable while moving the thus formed starting roll so that they can move in conformity with the increasing layers or increasing roller diameter. The pressure to be exerted on the layers being applied to the winding-up roller and to be absorbed by the guiding rollers 19 can be varied by means of a tension roller 21 cooperating with the endless belt 20 driven by motor means. The guided rollers 19 may selectively likewise be driven in order on one hand to reduce the pressing-on pressure and on the other hand to avoid slipping.

After at the winding-up station a predetermined web length has been wound upon the roller, a cutting operation will take place at the material cutting station 5. Subsequently the entire winding-up station is moved outwardly in the direction of movement of the web to such an extent that the cut-off material end will be located beyond the onwinding station accordingly, the bodies 10 and 11 will move together again while the new start of the web on the guiding table 4 will reach the onwinding station with inlets 6 and free chamber 7. As soon as the web end has reached the winding-up station 17, the guiding rollers 19 are pivoted upwardly, and the finished roller is ejected or released by means of the belt 20. From the start of the onwinding phase to the end of the winding-up phase, the entire process can be carried out fully automatically without requiring a change in the speed of the web.

It is, of course, to be understood that the present invention is, by no means, limited to the specific showing in the drawings but also comprises any modifications within the scope of the appended claims.

Thus, while any well-known means may be employed for causing the roller means 19 to eject or release the finished roll R of web material, a simple arrangement of this type may comprise an adjustable resiliently supported contact 22 of a switch which is connected to electromagnets 24 that are energized in response to the roll R obtaining a predetermined diameter, thereby moving the contact 22 against the contact 23 and closing the energizing circuit for electromagnets 24 to cause said roller means 19 to pivot outwardly.

What I claim is:

1. A method of producing rolls of web material, especially of self-supporting material, in a continuous process, which includes in combination in a cycle the steps of: at a first station withdrawing web material from a supply source and automatically winding upon supporting means a plurality of layers of web material so as to form a starting roll, moving the thus formed starting roll on said supporting means to a second station, at said second station separating said supporting means and said starting roll from each other and returning said supporting means to said first station while winding additional layers of web material onto said starting roll at said second station, and when the roll at said second station holds a desired number of coils of web material cutting off ahead of said first station the supply of web material from said supply source to said last mentioned roll, removing said last mentioned roll while repeating the above mentioned cycle, and the additional step of subsequently to cutting off the supply of web material from said supply source to the roll in said second station, also moving said second station with roll of web material away from said first station to such an extent that the pertaining cut off end section is beyond said first station when seen in the direction of feeding the web material to said station.

2. A device for producing rolls of web material, especially of self-supporting material, in a continuous process, which includes in combination: a first station for starting a roll of web material, feeding means operable to feed web material to said first station, said first station comprising a composite body having its components respectively defining semi-cylindrical recesses, said components being movable toward each other to define a substantially cylindrical chamber having inlet means for admitting web material to be rolled, said components also being movable away from each other to open said cylindrical chamber, said first station furthermore comprising mandrel means operable from opposite sides to move into and out of said cylindrical chamber, said mandrel means having an outer diameter less than the inner diameter of said chamber so as to define annular chamber means with the inner wall of said chamber when said mandrel means are in said chamber, motor means operatively connected to said mandrel means for rotating said mandrel means about their axes substantially at the web material feeding speed, a second station arranged behind said first station when looking in the web material feeding direction, means for conveying said mandrel means with the web material thereon from said first station to said second station, means for moving said mandrel means and the roll of web material thereon relative to each other so as to separate said last mentioned roll of web material from said mandrel means returned to said first station, roller means associated with said second station and operable selectively to frictionally engage and disengage a roll of web material therebetween, endless belt means forming a part of said second station and operable to frictionally and drivingly engage a roll of web material between said roller means and said endless belt to turn said roll of web material so as to wind additional layers of web material onto said roll of web material, cutting means between said feeding means and said first station for cutting said web material therebetween, and means operable in response to a roll of web material between said roller means and said endless belt reaching a desired diameter to cause said roller means to move away from each other to thereby cause said endless belt to effect release of a roll of web material engaged thereby.

3. A device in combination according to claim 2, in which said first station has a free wheeling device associated therewith operable to prevent a tearing off of the web of material if the speed of movement of the started roll from said first station to said second station should exceed the feeding speed at which the web material is fed from said feeding means to said first station.

* * * * *